US008438782B2

(12) United States Patent
Scharf et al.

(10) Patent No.: US 8,438,782 B2
(45) Date of Patent: May 14, 2013

(54) APPARATUS FOR SIMULTANEOUS LOUVER OPERATION ON ARCHED SHUTTERS

(75) Inventors: Richard Scharf, Escondido, CA (US); Roger Heald, San Diego, CA (US)

(73) Assignee: Harmonic Design, Inc., Poway, CA (US)

( * ) Notice: Subject to any disclaimer, the term of this patent is extended or adjusted under 35 U.S.C. 154(b) by 0 days.

(21) Appl. No.: 12/715,309

(22) Filed: Mar. 1, 2010

(65) Prior Publication Data

US 2011/0209408 A1 Sep. 1, 2011

(51) Int. Cl.
*E05F 15/20* (2006.01)
*E06B 7/096* (2006.01)

(52) U.S. Cl.
USPC ..... 49/74.1; 49/82.1

(58) Field of Classification Search ..... 49/74.1, 49/82.1
See application file for complete search history.

(56) References Cited

U.S. PATENT DOCUMENTS

| | | | | | |
|---|---|---|---|---|---|
| 602,967 | A * | 4/1898 | Wells | 160/134 |
| 705,202 | A * | 7/1902 | Buckman | 49/77.1 |
| 1,447,189 | A * | 3/1923 | Simon | 49/41 |
| 5,088,645 | A | 2/1992 | Bell | |
| 5,455,487 | A | 10/1995 | Mix et al. | |
| 5,469,658 | A * | 11/1995 | Digianni et al. | 49/82.1 |
| 5,471,789 | A * | 12/1995 | Faircloth | 49/74.1 |
| 5,537,780 | A * | 7/1996 | Cleaver et al. | 49/82.1 |
| 5,698,958 | A | 12/1997 | Domel et al. | |
| 5,713,156 | A * | 2/1998 | Briggs, Sr. | 49/82.1 |
| 5,918,417 | A * | 7/1999 | Kinder | 49/39 |
| 6,341,447 | B1 * | 1/2002 | Jean | 49/74.1 |
| 6,390,172 | B1 * | 5/2002 | Fleishman et al. | 160/168.1 V |
| 6,758,256 | B1 * | 7/2004 | Garcia | 160/134 |
| 6,877,546 | B1 * | 4/2005 | Garcia | 160/134 |
| 2001/0037604 | A1 * | 11/2001 | Gabriele | 49/74.1 |
| 2003/0159355 | A1 * | 8/2003 | Froerer et al. | 49/74.1 |
| 2006/0272214 | A1 * | 12/2006 | Simonelli et al. | 49/92.1 |
| 2011/0066302 | A1 | 3/2011 | McEwan | |

* cited by examiner

*Primary Examiner* — Katherine Mitchell
*Assistant Examiner* — Justin Rephann
(74) *Attorney, Agent, or Firm* — Procopio, Cory, Hargreaves & Savitch LLP; Noel C. Gillespie

(57) ABSTRACT

An arched shutter configured for automated, simultaneous control of a plurality of louvers, the arched shutter comprises the plurality of louvers, a frame, a portion of which forms an arch, a base, wherein the plurality of louvers are installed between the base and the portion of the frame that forms an arch via a plurality of rod arms, a motor configured to drive one of the plurality of rod arms and therefore one of the plurality of louvers, and a plurality of linking apparatus connecting the plurality of louvers such that all of the plurality of louvers operate when the one louver is driven by the motor.

20 Claims, 8 Drawing Sheets

-- PRIOR ART --

-- PRIOR ART --

-- PRIOR ART --

APPARATUS FOR SIMULTANEOUS LOUVER OPERATION ON ARCHED SHUTTERS

BACKGROUND

1. Technical Field

The embodiments described herein are related to automated window covering operation and more particularly, to an apparatus that allows all of the louvers of a arched shutter to operate automatically and simultaneously.

2. Related Art

FIG. 1 is a diagram illustrating an example arched shutter 100 comprising a plurality of louvers 102. In a conventional installation, such an arched shutter is often placed high above ground level such as above a window 200 or entry as illustrated in FIG. 2. As with many conventional shutters, or window coverings, the louvers of such an arched shutter 100 are operated manually. In fact, for most conventional arch shutters, each individual louver must be operated manually in order to open or close the louvers. Because an arched shutter 100 is often placed high above ground level it can be difficult to open and close louvers 102.

Systems do exist in which louvers 102 can be simultaneously operated using a string mechanism, but such systems are not very robust or precise. Conventional motorized systems are of no help, because they do not operate with a shutter in the form of an arch.

SUMMARY

An automated arched shutter that allows for simultaneous operation of the louvers of the arched shutter is described herein.

In one aspect, an arched shutter configured for automated, simultaneous control of a plurality of louvers comprises the plurality of louvers, a frame, a portion of which forms an arch, a base, wherein the plurality of louvers are installed between the base and the portion of the frame that forms an arch via a plurality of rod arms, a motor configured to drive one of the plurality of rod arms and therefore one of the plurality of louvers, and a plurality of linking apparatus connecting the plurality of louvers such that all of the plurality of louvers operate when the one louver is driven by the motor.

In another aspect, an environment control system comprises an arched shutter configured for automated, simultaneous control of a plurality of louvers, the arched shutter comprising the plurality of louvers, a frame, a portion of which forms an arch, a base, wherein the plurality of louvers are installed between the base and the portion of the frame that forms an arch via a plurality of rod arms, a motor configured to drive one of the plurality of rod arms and therefore one of the plurality of louvers, and a plurality of linking apparatus connecting the plurality of louvers such that all of the plurality of louvers operate when the one louver is driven by the motor; and a control system in communication with the motor, the control system configured to provide operating instructions to the motor.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 3:
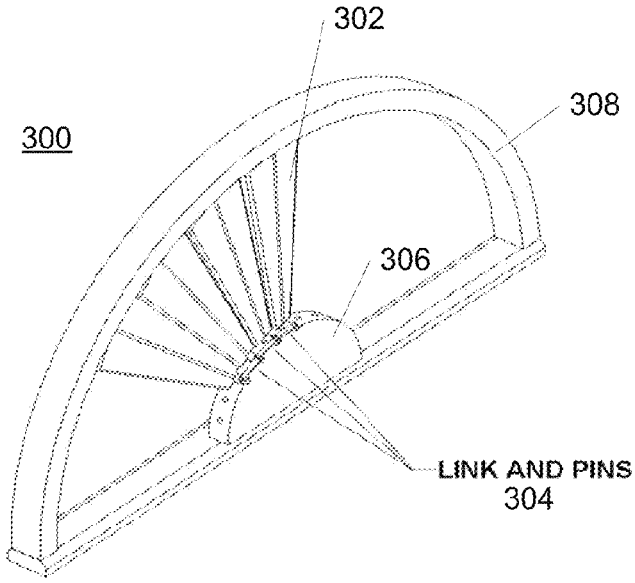
FIG. 3 is a diagram illustrating an example arched shutter with a motor and linking apparatus in accordance with one embodiment.

FIG. 3 is a diagram illustrating an example arched shutter 300 configured in accordance with one embodiment. As can be seen, arched shutter 300 comprises a plurality of louvers 302 of which only a few are shown. Louvers 302 are installed between a frame 308 and a base 306. In a conventional installation, base 306 and frame 308 include the mechanisms needed to allow louvers 302 to be opened and closed when manual force is applied to each individual louver 302. Alternatively, a mechanism such as a rack and pinion system or a set of gears with appropriate linkage can be included within frame 308 and/or base 306 so as to allow all of louvers 302 to open or close when manual force is applied to a single louver 302.

Unfortunately, however, there is no current method to allow automated actuation of louvers 302. Due to the positioning of arched shutter 300 (see FIG. 2 for example) it can therefore be difficult and inconvenient to open and close louvers 302.

In the embodiments described herein, a linking apparatus is used to link louvers 302 and allow them to be driven simultaneously by a motor. It will be appreciated by those of skill in the art that automating the operation of louvers 302 is not straight forward due to the shape of arched shutter 300. As a result, a specialized apparatus must be included to allow for automated operation of louvers 302.

Figure 4:
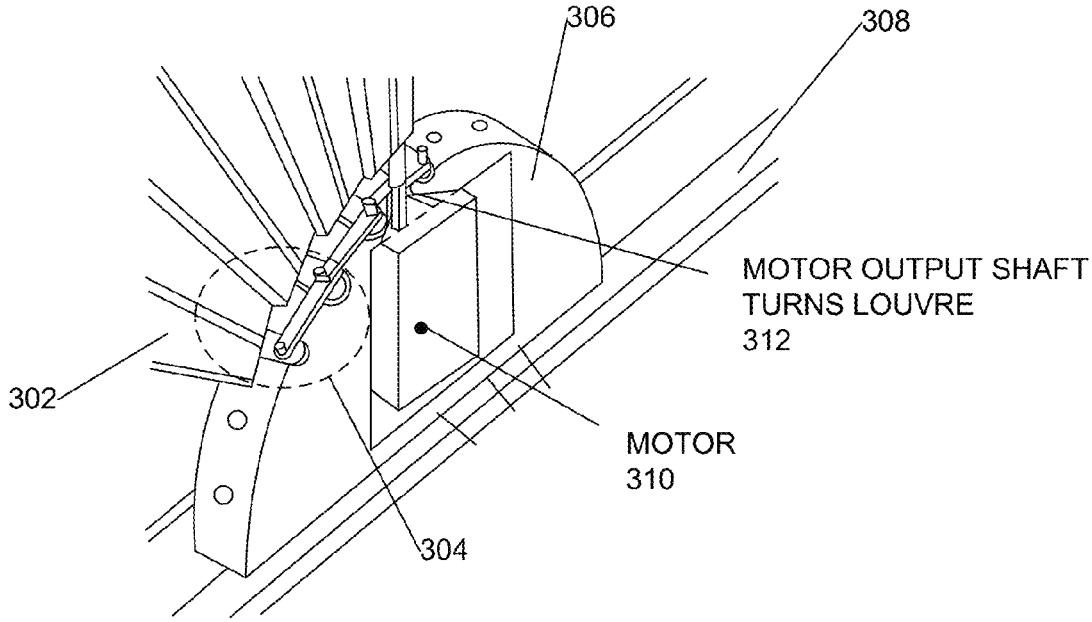
FIG. 4 is a diagram illustrating a close up view of the arched shutter of FIG. 3 illustrating the linkage between the motor, linking apparatus, and louvers.

FIG. 4 is a diagram illustrating a close up view of a portion of arched shutter 300 and illustrating linking apparatus 304 in more detail. As can be seen, linking apparatus 304 comprises two components: a piece connected with the rod arm 508 of each louver 302, and a linking piece linking adjacent linking apparatus 304 with each other.

Figure 5:
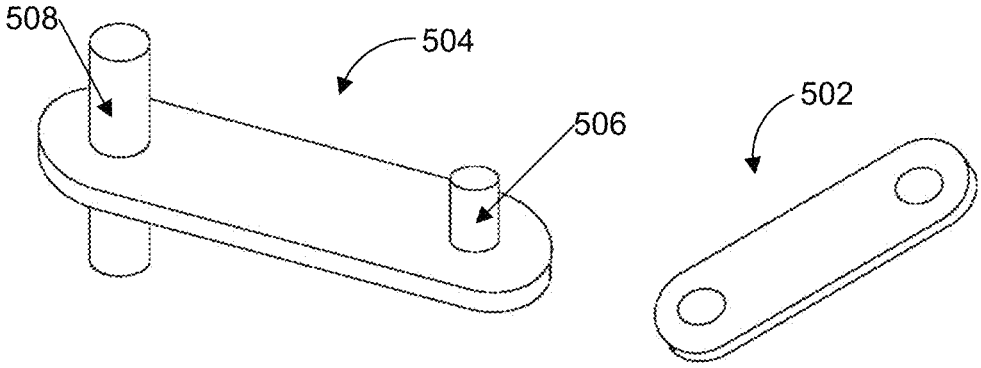
FIG. 5 is a diagram illustrating an example linking apparatus in accordance with one embodiment.

FIG. 5 is a diagram illustrating the components of linking apparatus 304 in more detail. As can be seen, piece 504 is coupled with rod arm 508 and also comprises a peg 506 onto which linking piece 502 can be placed via holes 510. Referring back to FIG. 4, it can be seen that linking piece 502 couples each louver 302 to the other via pegs 506 of the various pieces 504 coupled with the rod arms 508 of each louver 302.

As illustrated in FIG. 3, linking apparatus 304 link each of the plurality of louvers 304 in manner that allows louvers 302 to be operated simultaneously and in an automated fashion. One rod arm 508 (see FIG. 5) can then be coupled to a drive shaft 312 (see FIG. 4) that can be coupled with a motor 310. It will be understood that while drive shaft 312 is illustrated as being coupled with a louver 302 approximately in the center of arched shutter 300, anyone of the plurality of louvers 302 can be coupled with drive shaft 312 with the same effect.

Motor 310 can then be configured to actuate drive shaft 312 interfaced with one of the rod arms associated with one of the plurality of louvers 302 and thereby activate all of the plurality of louvers 302 simultaneously via linking apparatus 304. Thus, louvers 302 can be operated automatically and simultaneously. Moreover, motor 310 can be configured to operate remotely making operation of arched shutter 300 easy and convenient. In other embodiments, as described below, motor 310 can be coupled with environmental sensors, such that it operates in response to, e.g., changing light conditions, increasing the automation and making operation of arched shutter 300 even more convenient.

Figure 10:
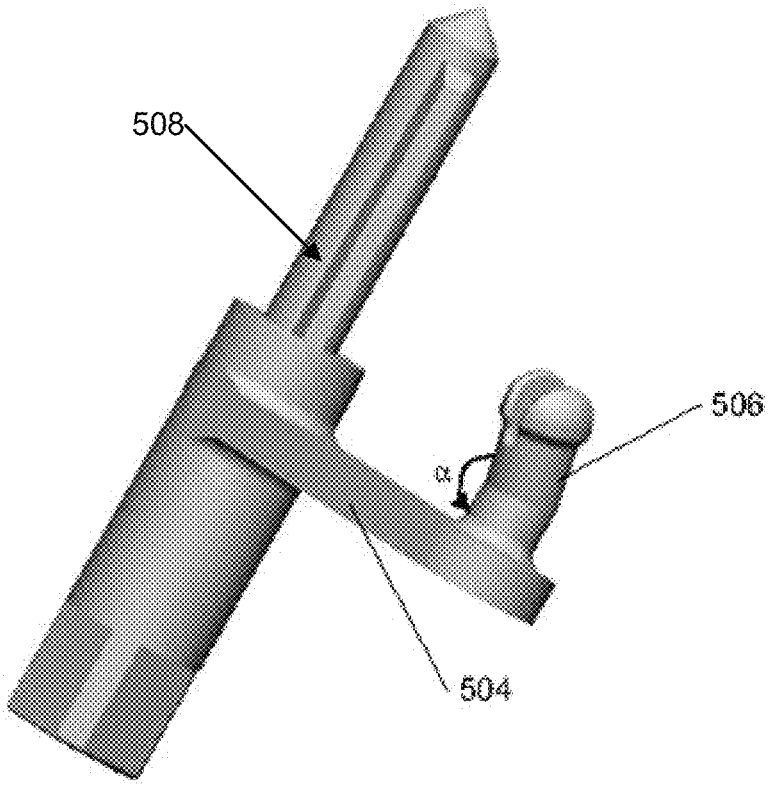
FIG. 10 is another diagram illustrating an example linking apparatus in accordance with one embodiment.

It should be noted that linking piece 502 (FIG. 5) may need to be designed to include a slight curve or angle from end to end in order to couple appropriately with pieces 504. Alternatively, as illustrated in the embodiment of FIG. 10, peg 506 can include a slight angle ($\alpha$) to allow for proper coupling. Moreover, other mechanisms besides pegs 506 and holes 510 can be used to link linking pieces 502 with pieces 504; however, the mechanism used must allow some play between the pieces for proper operation.

The pieces 502 and 504 of linking apparatus 302 can be constructed from a variety of materials including many plastics and metals. For example, a flexible plastic material can be preferable. In certain embodiments, Delrin™, Nylon™, or polyethylene can be used. Use of such materials allows for simple and inexpensive fabrication.

Co-owned U.S. Pat. No. 5,698,958 to Domel et al., entitled "Head Rail-Mounted Actuator For Window Coverings" (the '958 patent), which is incorporated herein by reference in its entirety as if set forth in full describes several motors and actuator systems that can be used to drive window coverings. It will be understood that motors and actuators such as those described in the '958 patent can also be used in conjunction with the embodiments described herein.

Figure 1:
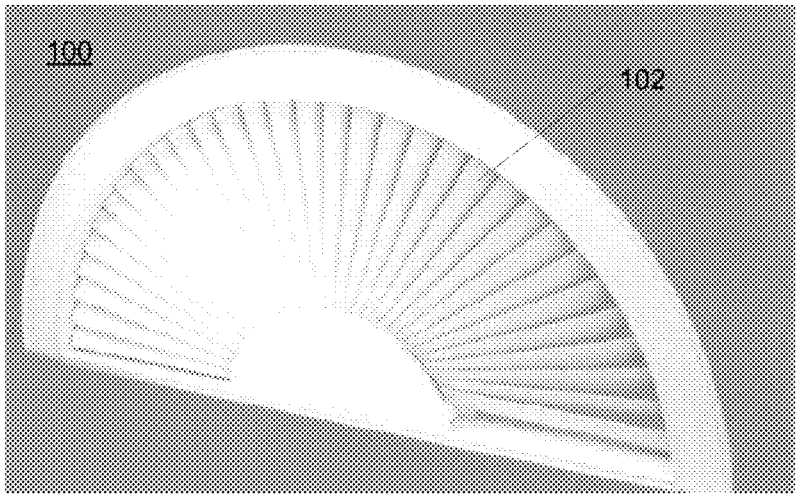
FIG. 1 is a diagram illustrating an example arch shutter.
Figure 2:
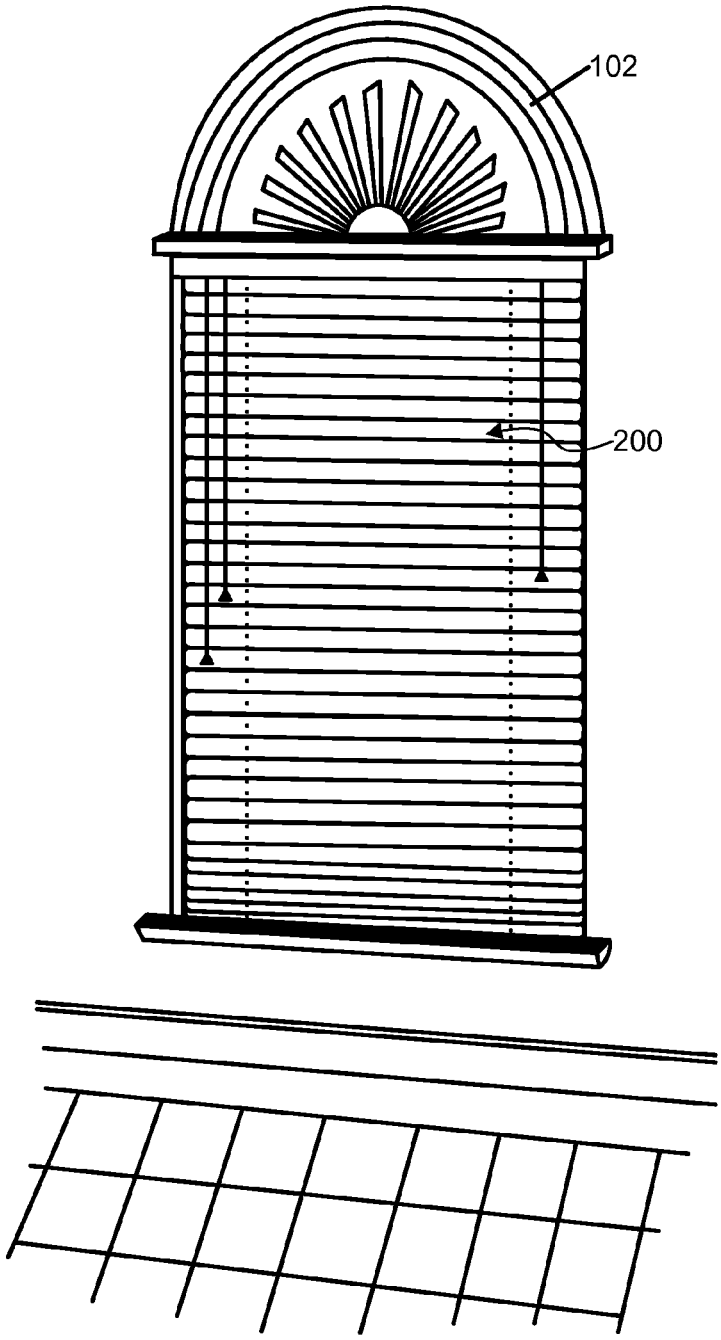
FIG. 2 is a diagram illustrating an example installation of an arch shutter such as that illustrating in FIG. 1.
Figure 6:
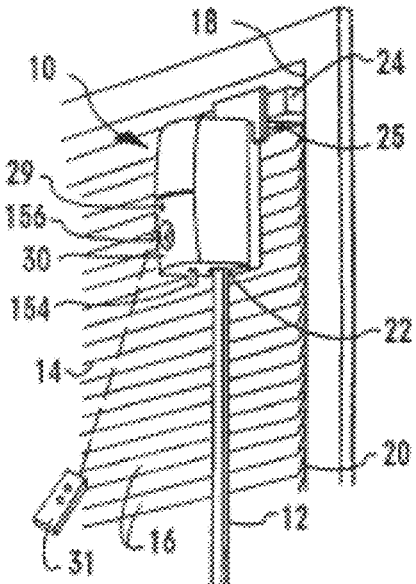
FIGS. 6-8 are diagram illustrating an example motor and actuator system that can be used in conjunction with the embodiments of FIGS. 3-5.
Figure 7:
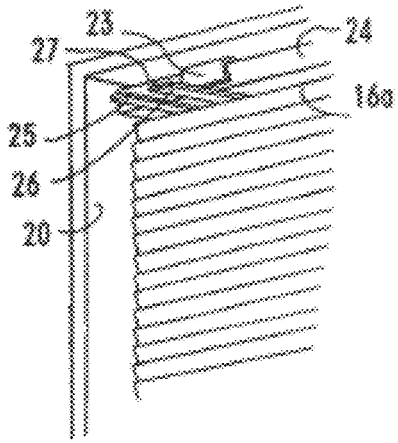
Figure 8:
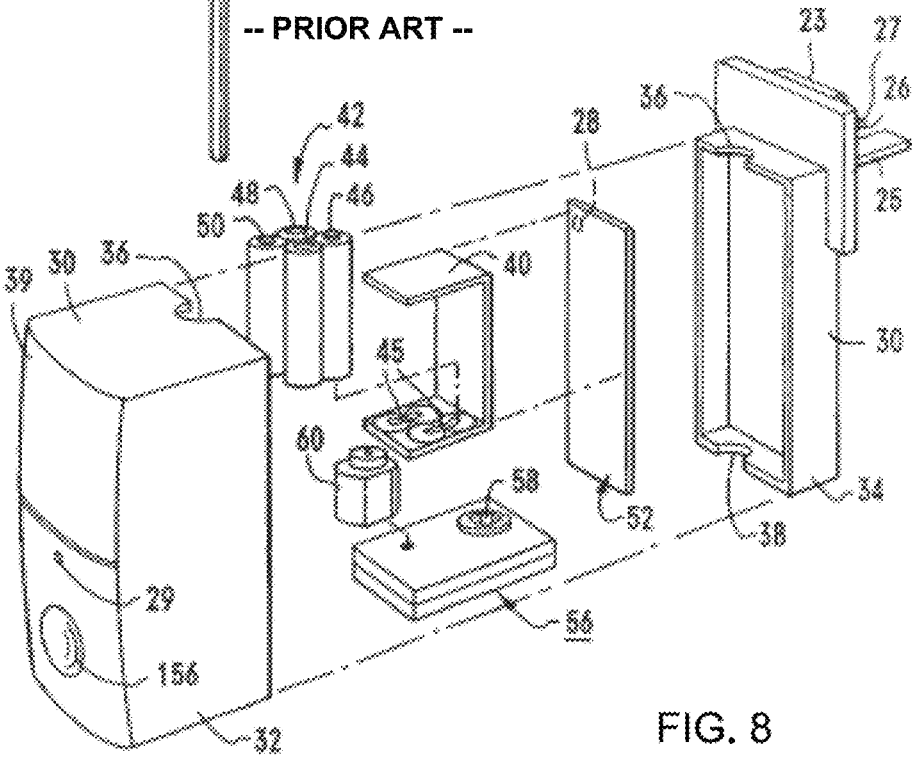

As described, e.g., in conjunction with FIGS. 1-3, a daylight sensor can a light sensor (reference numbers 28 and 29 in the '958 patent) can be included are interfaced with such a motor/actuator system. FIGS. 1-3 of the '958 patent are reproduced here as FIGS. 6-8 in order to illustrate sensors 28 and 29. The following paragraphs taken largely from the '958 patent describe the operation of sensors 28 and 29.

A control signal generator, preferably a daylight sensor 28 (shown in phantom in FIG. 3 of the '958 patent) is mounted on the actuator 10 by means well-known in the art, e.g., solvent bonding. The daylight sensor 28 can be in light communication with the light guide 26, which may or may not be included depending on the embodiment. Also, the sensor 28 can be electrically connected to electronic components within the actuator 10 to send a control signal to the components, as more fully disclosed below. Consequently, with the arrangement shown, the daylight sensor 28 can detect light that propagates through the window 20, independent of whether the mini-blind 14 is in the open configuration or the closed configuration.

Further, the actuator 10 can include another control signal generator, preferably a signal sensor 29, for receiving an optical, preferably visible red modulated user command signal. The user command signal can be generated by a hand-held user command signal generator 31, which advantageously can be a television remote-control unit. In one embodiment, the generator 31 generates a pulsed optical signal having a pulse rate of between about fifteen hundred microseconds and five thousand microseconds (1500.mu.s-5000.mu.s).

Like the daylight sensor 28, the signal sensor 29 is electrically connected to electronic components within the actuator 10. As discussed in greater detail below (in the '958 patent), either one of the daylight sensor 28 and signal sensor 29 can generate an electrical control signal to activate the actuator 10 and thereby cause the mini-blind 14 to move toward the open or closed configuration, as appropriate.

Preferably, both the daylight sensor 28 and signal sensor 29 are light detectors which have low dark currents, to conserve power when the actuator 10 is deactivated. More particularly, the sensors 28, 29 have dark currents equal to or less than about 10.sup.−8 amperes and preferably equal to or less than about 2.times.10.sup.−9 amperes.

Thus, as with the systems described in the '958 patent, a daylight sensor can be included in or coupled motor 310 to allow remote operation and or automated operation based on daylight conditions. Further, motor 310 can be interfaced, either wired or wirelessly, with a control system that allows custom configuration of such daylight control as well as, e.g., automated time of day operation.

Figure 9:
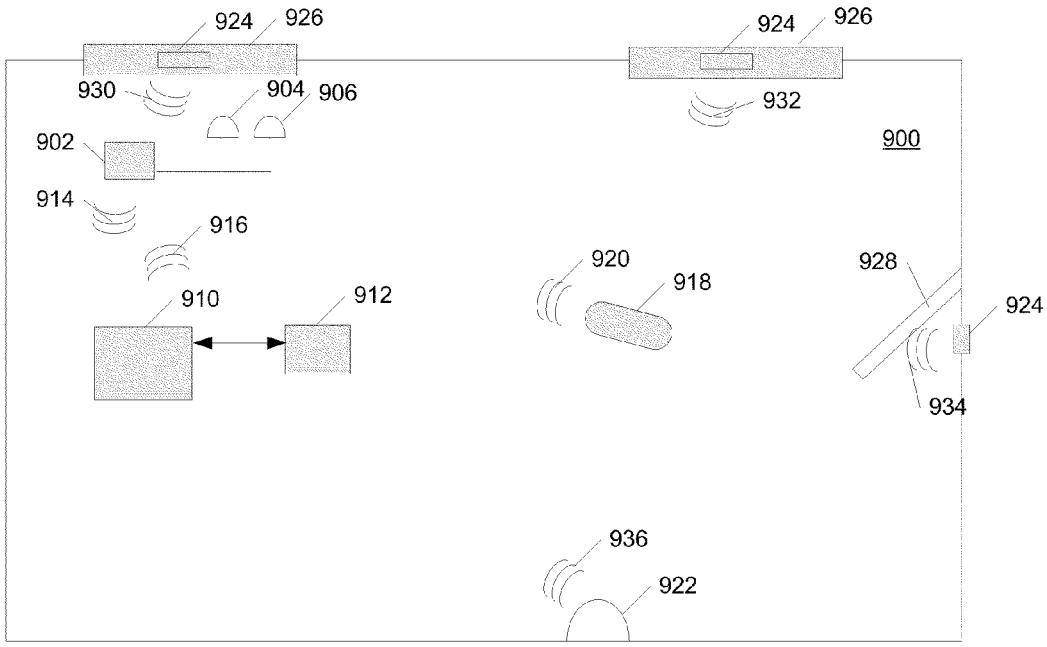
FIG. 9 is a diagram illustrating an environment control system in accordance with one embodiment and that can include an arched shutter such as that illustrated in FIG. 3.

For example, arched shutter 300 can actually be included in a much larger system that allows for automated control of lighting and temperature within a room or enclosure. FIG. 9 is a diagram illustrating such a system 900 in accordance with one embodiment. In the example of FIG. 9, system 900 is installed in a room, e.g., in a home, hotel, or office. In this example, the room has two windows 926 and a door 928. One of the windows 926 can, e.g., include an arched shutter 300. While the actual arched shutter 300 is not shown in FIG. 9 for simplicity, motor 902 can represent a motor, such as motor 310 include in the arched shutter, configured to control operation of arched shutter 300

As can be seen, a daylight sensor 904 and a signal sensor 906 can be coupled with motor 902, which can be configured to operate in response to information provided by sensors 904 and 906. Thus, for example, a remote control 918 can be configured to provide control signals 920 to signal sensor 906 to thereby control the operation of motor 902, or more specifically the position of the louvers of the associated arched shutter 300.

Signals 920 can be optical control signals or radio signals depending on the embodiment.

Additionally, motor 902 can be in communication via signals 914 and 916 with a control system 910. Control system 910 can include a processor or controller as well as the components, hardware and software; sensors; data storage; etc., needed to control, e.g., lighting, temperature, etc., within the room.

Motor 902 can, therefore, be coupled with a communications module (not shown) configured to generate signals 914 and/or receive signals 916. Signals 914 and 916 can be optical or radio signals. Thus, the communication module can be configured to generate and/or receive the appropriate type of signal. It will be understood that motor 902, sensor 904, sensor 906, and/or the communications module can be included in a single housing or as separate units depending on the embodiment.

Daylight sensor 904 can then be communicatively coupled with control system 910, either directly or via motor 902, or more specifically the communications module. Similarly, any, all, or a combination of a temperature sensor 912, motion sensors 924, and presence detector 922 can be communicatively coupled with control system 910 either via a wired or wireless interface. In the example of FIG. 9, temperature sensor 912 is shown as being connected via a wired connection with control system 910, while motion detectors 924 and presence detector 922 are illustrated as being coupled with control system 910 via wireless communication signals 930, 932, 934, and 936.

Again, signals 930, 932, 934, and 936 can be optical or radio signals depending on the embodiment.

Motion detectors 924 can be configured to detect the status of windows 926 and door 928, e.g., in order to detect wither someone has entered the room or whether one of the windows or door is open. Presence detector 922 can be configured to detect whether an individual is in the room.

Control system 910 can then be configured to control the operation of motor 902 based on the inputs from the various systems. This control can be part of a larger control program to control the environment, e.g., lighting and temperature within the room. For example, control system 910 can be configured to control the temperature in the room in part by controlling the position of louvers of various shutters in the room, including an arched shutter, based on the time of day, amount of light entering the room or incident on one of windows 926, the temperature, or some combination thereof.

In another example, e.g., depending on the time of day, control system 910 can be configured to control motor 902 to control the position of an associated set of louvers, when someone enters the room. For example, if there is plenty of daylight available, as detected by sensor 904, and someone enters the room, as detected by the associated motion detector 924 and/or presence detector 922, then control system 910 can be configured to open louvers covering windows 926 to let more natural light into room 926. This is not only convenient but can save electricity if, for example, it prevents the occupant from turning on a light.

Further, upon detection that the occupant has left, control system 910 can be configured to control, e.g., motor 902 and the associated louvers to close the louvers and limit the amount of light coming in when no one is in the room. This can for example, prevent the temperature from rising too much when no one is in the room and lower cooling costs.

It will be understood that a variety of heating, cooling, lighting, etc., control programs can be implemented by control system 910 based on the various inputs to control system 910 and based at least in part by control of motor 902. It will also be understood that control system 910 can also be interfaced with a heating and cooling system and well as an artificial lighting system to control such systems based on the various sensor inputs.

It will also be understood that in other embodiments, a rotational gear set can be used to drive louvers 302 as opposed to a drive shaft 312. In general, it will be further understood that other methods for simultaneously driving the louvers can be used in conjunction with the embodiments described herein.

While certain embodiments have been described above, it will be understood that the embodiments described are by way of example only. Accordingly, the systems and methods described herein should not be limited based on the described embodiments. Rather, the systems and methods described herein should only be limited in light of the claims that follow when taken in conjunction with the above description and accompanying drawings.

What is claimed is:

1. An arched shutter configured for automated, simultaneous control of a plurality of louvers, the arched shutter comprising:

the plurality of louvers;

a frame, a portion of which forms an arch;

a base, wherein the plurality of louvers are installed between the base and the portion of the frame that forms an arch via a plurality of rod arms;

a motor configured to drive one of the plurality of rod arms and therefore one of the plurality of louvers; and a plurality of linking apparatus connecting the plurality of louvers such that all of the plurality of louvers operate when the one louver is driven by the motor;

wherein each of the plurality of linking apparatus comprises a first piece connected with a rod arm associated with one of the plurality of louvers and comprising a bent peg, and a second piece comprising holes configured to receive the bent peg and configured to connect the first piece with the first piece of an adjacent linking apparatus of the plurality of linking apparatus.

2. The arched shutter of claim 1, wherein the motor includes a drive shaft coupled to the one of the plurality of rod arms, and wherein the motor is configured to drive the one louver via the drive shaft.

3. The arched shutter of claim 1, wherein the motor is further configured to drive said one of the plurality of rod arms by rotating a drive shaft coupled to the motor.

4. The arched shutter of claim 1, wherein the plurality of linking apparatus are constructed from a flexible plastic material.

5. The arched shutter of claim 1, further comprising a daylight sensor coupled with the motor, the daylight sensor configured to sense daylight conditions and control operation of the motor in response thereto.

6. The arched shutter of claim 5, wherein the daylight sensor and the motor are coupled with a control system, and wherein data from the daylight sensor is communicated to the control system and the control system in turn controls operation of the motor in response to the data.

7. The arched shutter of claim 1, further comprising a signal sensor coupled with the motor, the signal sensor configured to receive a control signal and to control operation of the motor in response to the control signal.

8. The arched shutter of claim 1, wherein the motor coupled with a temperature sensor, and wherein the motor operates in response to temperature data provided by the temperature sensor.

9. The arched shutter of claim 1, wherein the motor is coupled with a control system, and wherein the motor is configured to operate in response to control signal received from the control system.

10. An environment control system, comprising:

an arched shutter configured for automated, simultaneous control of a plurality of louvers, the arched shutter comprising:

the plurality of louvers, a frame, a portion of which forms an arch, a base, wherein the plurality of louvers are installed between the base and the portion of the frame that forms an arch via a plurality of rod arms, a motor configured to drive one of the plurality of rod arms and therefore one of the plurality of louvers, and a plurality of linking apparatus connecting the plurality of louvers such that all of the plurality of louvers operate when the one louver is driven by the motor; and a control system in communication with the motor, the control system configured to provide operating instructions to the motor, wherein each of the plurality of linking apparatus comprises a first piece connected with a rod arm associated with one of the plurality of louvers and comprising a bent peg, and a second piece comprising holes configured to receive the bent peg and configured to connect the first piece with the first piece of an adjacent linking apparatus of the plurality of linking apparatus.

11. The environment control system of claim 10, wherein the motor includes a drive shaft coupled to the one of the plurality of rod arms, and wherein the motor is configured to drive the one louver via the drive shaft.

12. The environment control system of claim 10, wherein the motor is further configured to drive said one of the plurality of rod arms by rotating a drive shaft coupled to the motor.

13. The environment control system of claim 10, wherein the plurality of linking apparatus are constructed from a flexible plastic material.

14. The environment control system of claim 10, further comprising a daylight sensor coupled with the motor, the daylight sensor configured to sense daylight conditions and control operation of the motor in response thereto.

15. The environment control system of claim 14, wherein the daylight sensor is coupled with the control system, and wherein data from the daylight sensor is communicated to the control system and the control system in turn controls operation of the motor in response to the data.

16. The environment control system of claim 10, further comprising a signal sensor coupled with the motor, the signal sensor configured to receive a control signal and to control operation of the motor in response to the control signal.

17. The environment control system of claim 10, further comprising a temperature sensor coupled with the motor, and wherein the motor operates in response to temperature data provided by the temperature sensor.

18. The environment control system of claim 10, further comprising a temperature sensor coupled with the control system, and wherein the control system controls operation of the motor in response to temperature data provided by the temperature sensor.

19. The environment control system of claim 10, further comprising a motion sensor in communication with the control system and configured to detect a status of a window or door and provide the status to the control system, and wherein the control system is configured to control operation of the motor based on status provided by the motion sensor.

20. The environment control system of claim 10, further comprising a presence detector in communication with the control system and configured to detect presence of an individual and provide presence information to the control system, and wherein the control system is configured to control operation of the motor based on the presence information provided by the motion sensor.

* * * * *